United States Patent [19]

Riddel

[11] 3,952,709

[45] Apr. 27, 1976

[54] ORBITAL VANE ROTARY MACHINE

[75] Inventor: John W. Riddel, Fenton, Mich.

[73] Assignee: General Motors Corporation, Detroit, Mich.

[22] Filed: Oct. 23, 1974

[21] Appl. No.: 517,211

[52] U.S. Cl. ..... 123/8.31; 123/8.33; 418/241; 418/265

[51] Int. Cl.[2] ..... F02B 53/04

[58] Field of Search ..... 123/8.27, 8.31, 8.33, 123/8.35; 418/138, 241, 253, 256, 257, 259, 265

[56] References Cited

UNITED STATES PATENTS

| | | | |
|---|---|---|---|
| 1,116,781 | 11/1914 | Amey | 123/8.31 |
| 1,607,383 | 11/1926 | Aurand | 418/138 X |
| 1,921,782 | 8/1933 | Schaefer | 123/8.33 |
| 2,734,461 | 2/1956 | Porte | 418/138 |
| 3,872,840 | 3/1975 | Adragna | 123/8.27 X |

FOREIGN PATENTS OR APPLICATIONS

| | | | |
|---|---|---|---|
| 1,426,011 | 2/1969 | Germany | 123/8.27 |

*Primary Examiner*—C. J. Husar
*Assistant Examiner*—Leonard Smith
*Attorney, Agent, or Firm*—Charles R. Engle

[57] ABSTRACT

An orbital vane rotary machine including a housing defining a cavity having two halves, each half being a cylinder which intersects with the other at a cavity minor axis. The centers of the cylinders are spaced a predetermined distance defining a cavity major axis. Trunnions are secured to the housing at each cylinder center and vanes of separate vane sets rotate about the trunnions while extending and retracting in slots in a rotor connected to an output shaft. The vanes extend and engage the housing while rotating through the cavity half where their trunnion is located and retract while rotating through the other cavity half.

3 Claims, 9 Drawing Figures

ORBITAL VANE ROTARY MACHINE

This invention relates to an orbital vane rotary machine having vanes rotatably supported upon a trunnion which are moved and slide relative to a rotor rotating within the machine housing. More specifically, this invention relates to an orbital vane rotary machine having two trunnions fixed to the housing and positioned on displaced centers so that separate vane sets slidably positioned in the rotor engage a respective cavity half as the rotor rotates through that particular portion of the housing cavity.

In the presently commercial rotary engine having a two-lobed internal peripheral housing and a three-lobed planetary rotor, it is difficult to machine the trochoidal form necessary to permit planetation of the three-lobed rotor within the cavity while maintaining a tight sealed engagement of the rotor apexes with the internal housing surface. Also, the assembly of gas seals along a peripheral edge of the triangularly shaped rotor requires separate machining operations as well as separate assembly operations in installing each segment of the gas seal. Further, these structures require installation of phasing gears so that the rotor planetates in a specific relationship relative to rotation of the output shaft. The inclusion of the phasing gears also requires further machining operations and additional assembly operations in establishing the desired planetating motion.

These disadvantages are overcome by the structure of my invention by employing a cylindrically shaped rotor slidably receiving a plurality of vanes rotating about fixed trunnions in a two circular lobed housing cavity. The lobes of the cavity are on spaced centers and a trunnion supporting a vane set is fixed at each center. The vanes extend and retract in the rotor as it rotates on an axis with the output shaft. Consequently the problem of machining a trochoidal form and the associated specific machining operations relating to installing several seal segments along the periphery of the rotor are eliminated. A further advantage of my invention resides in the fact that the number of vanes slidably mounted in the rotor can be varied to obtain various cycles of operation through one complete revolution of the rotor.

Accordingly, a prime object of the present invention is the provision of an orbital vane rotary machine including a housing defining a two-lobed circular cavity which contains a rotor rotating at the center thereof and containing a plurality of vane sets which extend and retract during rotation of the rotor and engage the machine housing at specified times providing a plurality of operational cycles during each revolution of the rotor.

Another object of the present invention is the provision of an orbital vane rotary internal combustion engine including a two-lobed circular housing wherein a first set of vanes extend from a rotor and compress an air-fuel mixture in one engine cavity half while a second set of vanes extend and respond to combustion of the compressed air-fuel mixture and power and output shaft during rotation through a second cavity half.

A further object of the present invention is the provision of an orbital vane rotary internal combustion engine including a circular rotor rotating within a two-lobed circular engine housing cavity, the rotor slidably containing a plurality of vanes in separate vane sets mounted upon fixed trunnions so that a first set of vanes extend and engage the engine housing and compress an air-fuel mixture during rotation through a first cavity half and a second set of vanes extend and engage the engine housing during rotation of the rotor through a second cavity half, the first vane set compressing the air-fuel mixture in the first cavity half while the second vane set responds to combustion and rotates the rotor and an output shaft while sweeping burned exhaust gases out of the second cavity half.

Another object of the present invention is the provision of an orbital vane rotary internal combustion engine employing a plurality of vane sets in a circular rotor which extend and retract during rotation of the rotor within an engine housing cavity, the vanes engaging the engine housing cavity walls in a manner such that seal units in the end surfaces of the vanes are not required.

The novel features which I believe to be characteristic of my invention are set forth with particularity in the appended claims. My invention itself, however, both as to its organization and method of operation, may be best understood by reference to the following description taken in conjunction with the accompanying drawings in which:

Figure 1:
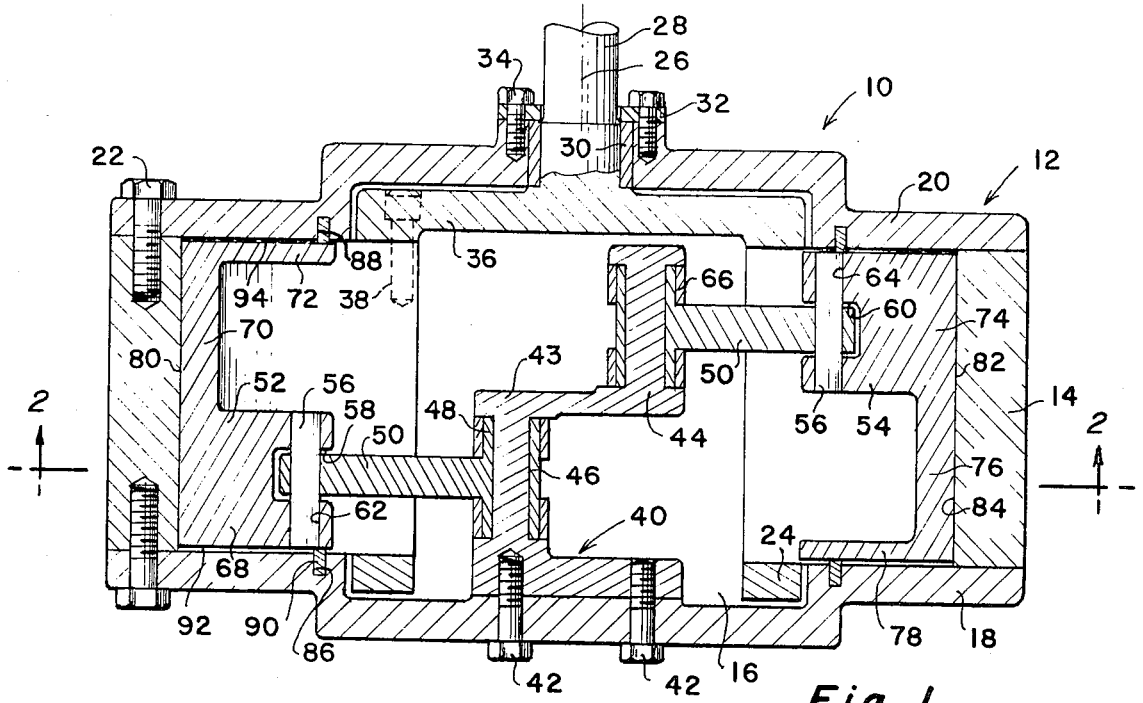
FIG. 1 is a longitudidnal view with parts in section of an orbital vane rotary machine constructed in accordance with my invention.

Referring now to FIG. 1, an orbital vane rotary machine 10 constructed in accordance with my invention includes a housing assembly 12 consisting of a central peripheral portion 14 defining a two-lobed circular cavity 16 which is enclosed on either side by side plates 18 and 20. The side plates 18 and 20 are secured to the central housing portion 14 by a plurality of machine screws 22. A rotor 24 is centrally located within the cavity 16 and is disposed to rotate about a central axis 26. An output shaft 28 is rotatably supported in a journal bearing 30 retained in housing plate 20 by an apertured bearing plate 32 in turn retained by a plurality of machine screws 34. The output shaft 28 terminates in an enlarged circular flange portion 36 which is secured to the rotor 24 via a plurality of machine screws 38.

Housing side plate 18 has a trunnion assembly 40 secured thereto by virtue of machine screws 42, the trunnion assembly 40 including a first trunnion member 43 and a second trunnion member 44. The first and second trunnion members 43 and 44 each include a reduced journal portion 46 slidably and rotatably receiving slipper portions 48 of links 50 which are connected to orbiting vanes 52 and 54 via connecting pins 56. The vanes 52 and 54 contain notches 58 and 60 and apertures 62 and 64 permitting receipt of connecting pins 56 providing a pivotal connection between the links 50 and the respective vanes 52 and 54. The slippers 48 are rotatably retained upon the journal portions 46 of trunnions 43 and 44 by retaining bands 66 disposed on either side of the links 50.

It is significant that the vanes 52 and 54 are in a specific form as illustrated in FIG. 1. The vanes connected to trunnion 43 include a depending portion 68 which contains the aforementioned notch 58 and aperture 62 providing a means for connecting the link 50 in a pivotal relationship. The vanes 52 extend substantially the axial length of cavity 16 and have a portion of reduced area 70 intermediate the depending portion 68 and an oppositely disposed relatively narrow depending portion 72. The vanes 54 are of opposite construction in that a depending portion 74 is aligned with the second trunnion 44 while a portion of reduced area 76 is aligned with the first trunnion 43 and connects with a depending portion of relatively narrow area 78.

The vanes 52 and 54 terminate in end surfaces 80 and 82. In order to provide a sealed chamber containing a compressed fluid for subsequent expansion and propulsion of the rotary machine it is necessary that the end surfaces 80 and 82 of the vanes slidably engage inner peripheral surface 84 partially defining the cavity 16. Side sealing is accomplished both by seal grooves 86 and 88 in side plates 18 and 20, each of which contains a seal 90 biased into engagement with side surfaces 92 and 94 of the vanes 52 and 54.

Figure 2:
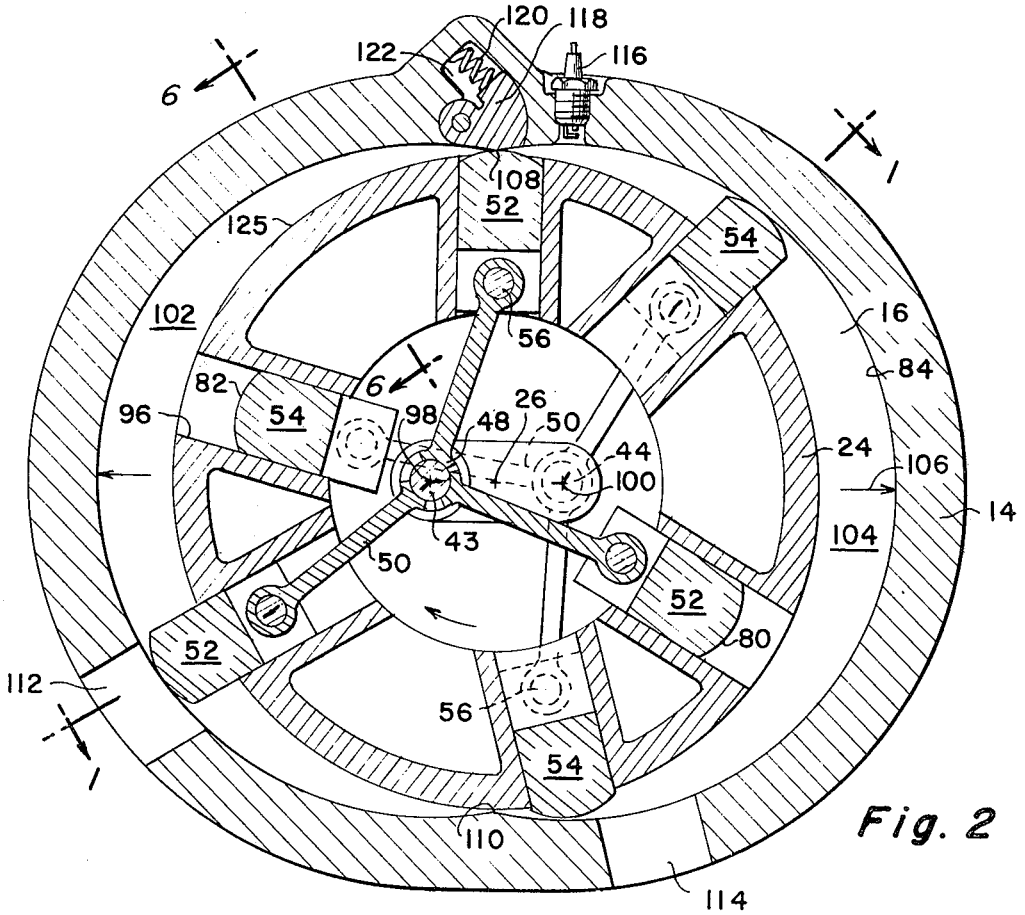
FIG. 2 is a cross-sectional view taken along line 2—2 of FIG. 1 illustrating the rotor containing sliding orbital vanes in accordance with my invention.

With reference now to FIG. 2, the rotor 24 contains a plurality of equiangularly spaced vane slots 96 slidably receiving vanes 52 and 54 of first and second vane sets which are connected by their respective links 50 for rotation about their respective trunnions 43 and 44. As illustrated, the trunnions 43 and 44 are positioned at centers 98 and 100 of circular lobe halves 102 and 104 of the cavity 16. The centers 98 and 100 are spaced a predetermined distance apart relative to the center axis 26 of the output shaft 28 and rotor 24 so as to provide a predetermined major cavity axis 106. The diameter of rotor 24 is substantially equal to the minor axis of the cavity 16 which is defined by top dead center point 108 and the similar point 110 at bottom dead center.

In the particular configuration shown in FIG. 2, the rotary machine 10 is configured for operation as an orbital vane rotary internal combustion engine. In such an arrangement it is necessary to include an intake port 112 which can be located in the central housing portion 14 as illustrated. Likewise it is necessary to include an exhaust port 114 which can also be formed in the central housing portion 14. Additionally it is necessary to include an ignition means, in the form of a spark plug 116, which can be located just past the top dead center position 108. A further component frequently utilized in a rotary internal combustion engine is a transfer valve such as valve 118 which includes top dead center point 108 and is biased to a rotor engaging position by a spring 120 located in a housing cavity 122. This arrangement assures rubbing contact of the rotor peripheral surface 125 and the end surfaces 80 and 82 of the vanes 52 and 54 with the point 108 when the rotor rotates from lobe 102 into lobe 104.

Figure 3:
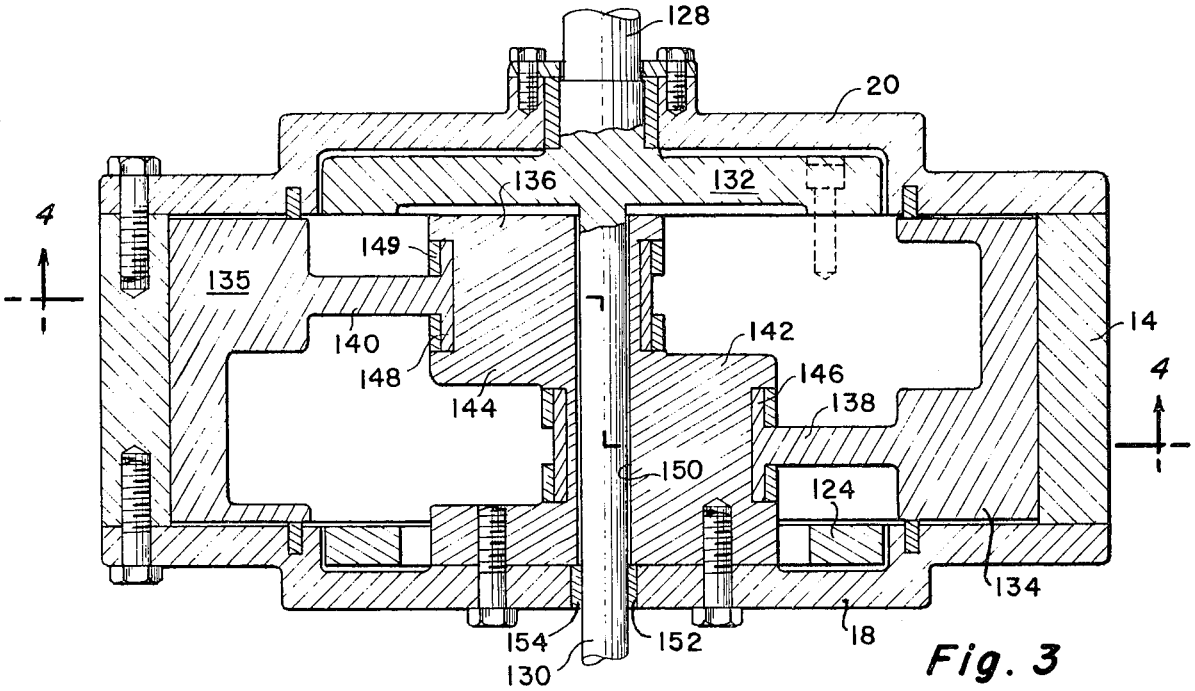
FIG. 3 is a longitudinal view with parts in section of an orbital vane rotor internal combustion engine having a rotor drivingly connected to both an output shaft and an accessory shaft according to the present invention.

A modified form of my invention is shown in FIG. 3 wherein the housing assembly, including the central housing member 14 and the side plates 18 and 20, rotatably supports an output shaft 128 having an accessory shaft 130 connected to a flanged portion 132. The flange 132 provides the driving connection between the shaft 128 and rotor 124. Also in this arrangement, the respective vanes 134 and 135 have integral depending portions 138 and 140 providing the connecting link to trunnions 142 and 144. The integral depending portions terminate in slipper members 146 and 148 which are slidably retained upon the trunnions 142 and 144 by connecting bands 149 in a manner similar to that previously described with regard to the structure in FIG. 1.

The utilization of an accessory drive shaft 130 necessarily requires the provision of an aperture 150 in the trunnions 142 and 144 and also requires an aperture 152 in end plate 18. The aperture 152 contains a journal bearing 154 providing for rotation of the shaft 130 in plate 18.

Figure 4:
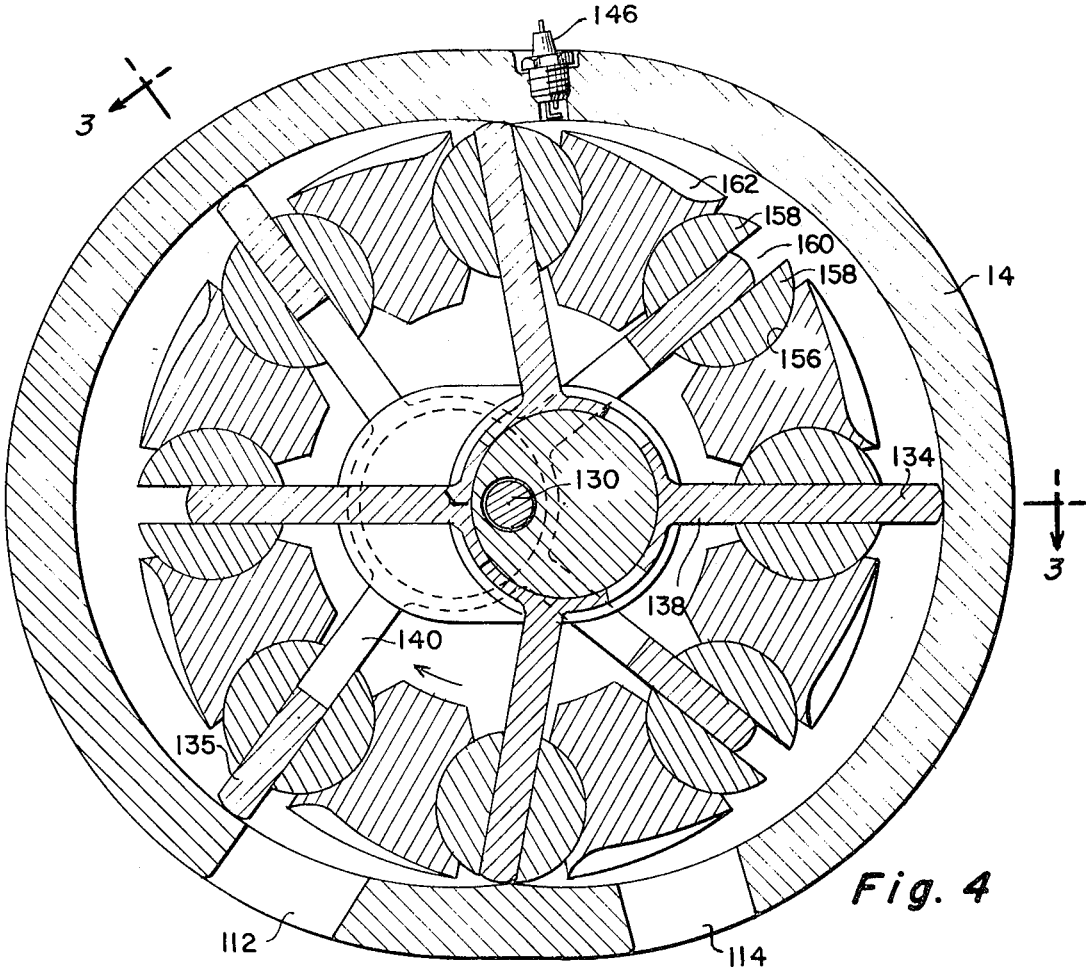
FIG. 4 is a view taken along line 4—4 of FIG. 3 illustrating a rotor centrally positioned within a housing having circular lobes.

With reference now to FIG. 4, the utilization of fixed depending link members 138 and 140 on the respective vanes 134 and 135 requires a provision for pivotal movement in the rotor 124 as the vanes rotate about their respective trunnions. This is accomplished by providing cylindrical grooves 156 extending the axial length of rotor 142. These grooves received swivel bearing members 158 which are in the form of segments of cylinders, a pair of the swivel bearing members 158 being placed in each groove 156 defining a vane slot 160. The swivel bearing members 158 are dimensioned to permit a close sliding engagement of the vanes 134 and 135 in the vane slots 160.

Rotor 124, in the embodiment illustrated in FIG. 4, is also modified to include a plurality of combustion pockets 162 in its peripheral surface between adjoining vanes 134 and 135 which also rotate about their respective trunnions 142 and 144. The formation of combustion pockets 162 in the rotor periphery eliminates the necessity of providing a transfer valve 118 previously described with reference to the structure in FIG. 2. The combustion pockets carry the compressed mixture into the combustion chamber just past top dead center for ignition by the spark plug 116.

Figure 5:
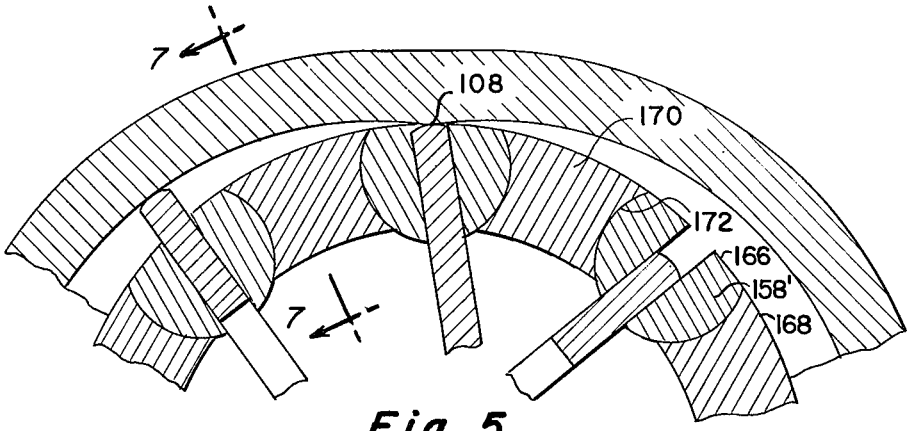
FIG. 5 is a fragmentary view with parts in section illustrating a modified form of swivel bearings providing a sliding surface for the orbital vanes of my invention.

A modified form of the swivel bearing segments is illustrated in FIG. 5. The swivel bearing elements 158' are machined to present a surface 166 having a radius equal to that of the peripheral surface 168 of a modified rotor 170. With this form of swivel bearing it is necessary to provide a cylindrical groove 172 having a diameter compensating for the change in shape of the segments 158'. Incorporation of the surface 166 provides a more continuous surface at the top dead center point 108 during rotation of the rotor 170.

Figure 6:
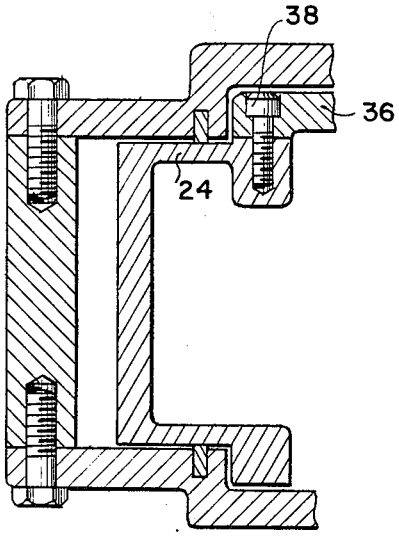
FIG. 6 is a fragmentary view with parts in section illustrating one method of sealing mounting the rotor within the engine housing and a method of attaching the output shaft to the rotor.
Figure 7:
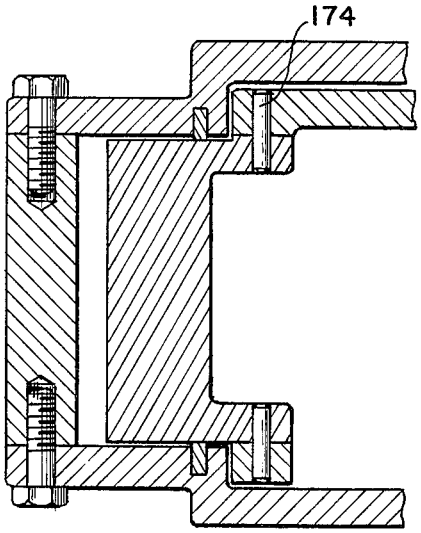
FIG. 7 is a fragmentary view with parts in section illustrating a modified form of connecting the output shaft to the rotor.

The structures illustrated in FIGS. 6 and 7 disclose methods of connecting the flanged portion 36 of output shaft 28 to the rotor 24. In FIG. 6 this is accomplished by a plurality of machine screws 38 while in FIG. 7 the connection is accomplished by virtue of a plurality of press-fit friction pins 174.

Figure 8:
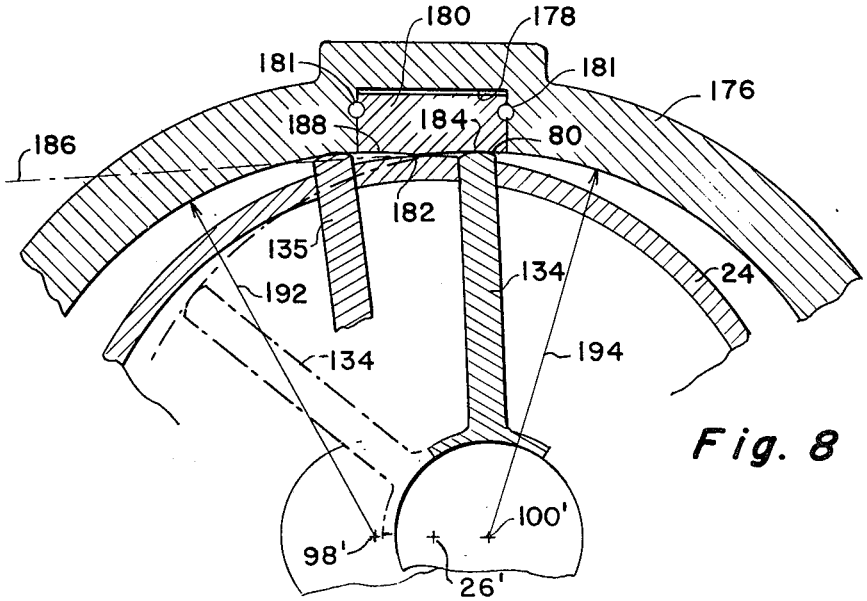
FIG. 8 is a fragmentary view with parts in section illustrating utilization of an adjustment block to regulate the clearance at top dead center in an engine housing so as to prevent back flow of a compressed air-fuel mixture as it passes into a combustion area.
Figure 9:
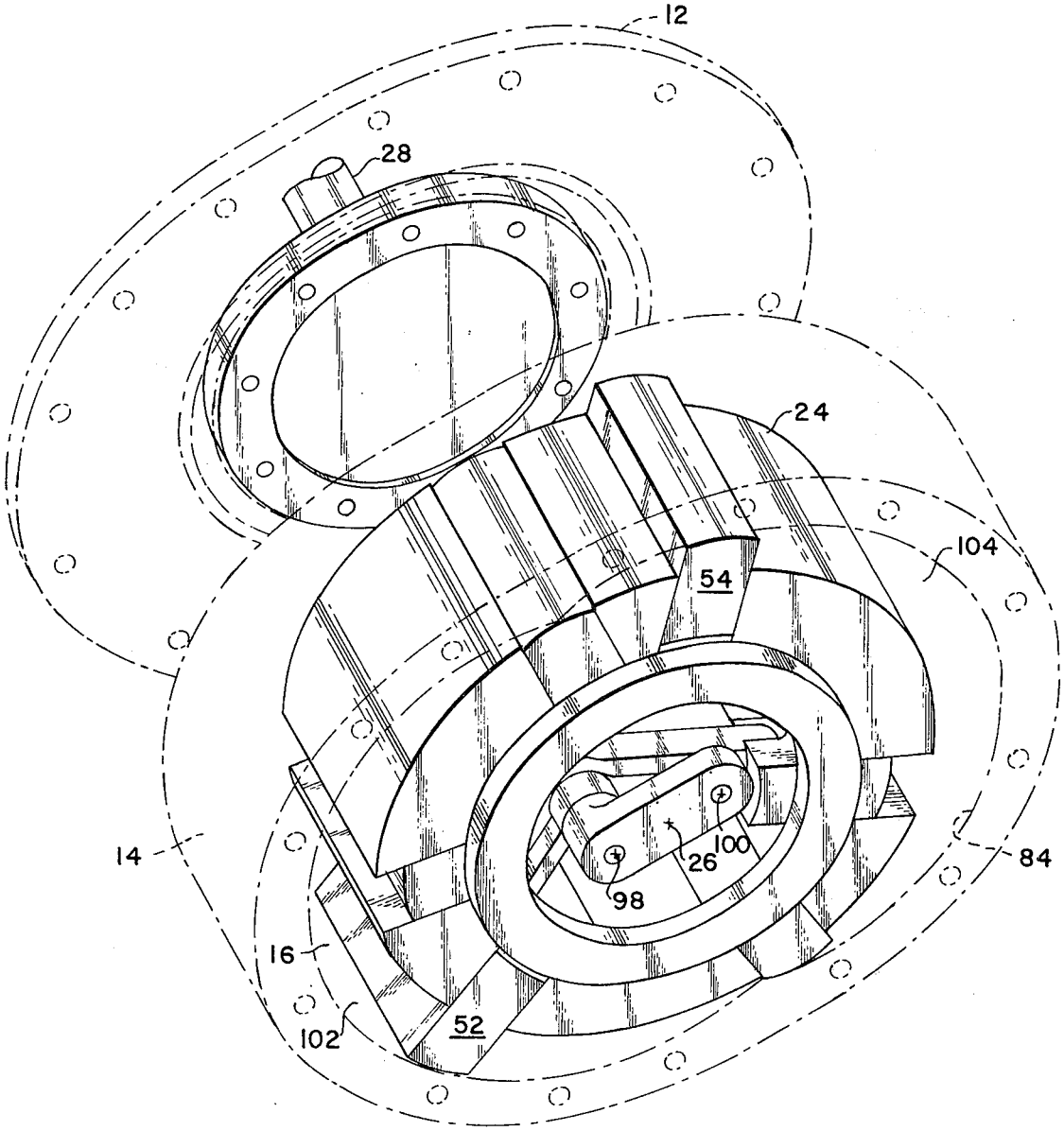
FIG. 9 is a perspective view with parts in phantom illustrating the association of the individual components of my rotary machine in assembled relationship.

In FIG. 8, a central housing member 176 has been modified to contain a cavity 178 which receives an adjustment block 180 retained in a predetermined fixed position by a plurality of pins 181. The inner surface of the adjustment block 180 has a predetermined configuration and more specifically in preferred form includes a flat surface from point 182 to point 184 which when extended is on a tangent 186 to a rotor combustion pocket when it is rotated to the position of point 184. The surface 188 of the adjustment block 180 has a radius 192 permitting movement of the vanes into the vicinity of the top dead center position during rotation of rotor 24. This precise contour on adjustment block 180 permits the vanes 135 rotating about center 98' to sweep over surface 188 and begin withdrawal into the rotor. With regard to vanes 134, they begin extending from the rotor and engage the block at point 184. The timing of this engagement is such that flow of the compressed air-fuel mixture back past the top dead center point is prevented and the compressed mixture remains ahead of the vane 134 shown in FIG. 8 for subsequent combustion.

A perspective view of the rotor 24, containing the first and second vanes sets including vanes 52 and 54, is shown located within an engine housing illustrated in phantom. A vane 52 is shown extended into the first half 102 of the cavity 16 while a vane 54 is extended into a second cavity half 104 of the cavity 16.

In operation, during rotation of vanes 52 through the first cavity half 102, the vanes 52 are extended into engagement with inner peripheral surface 84 of housing 14. This is accomplished by configuring links 50 and the vanes 52 to have a combined length equal to the radius of the cavity half 102 when the axis of the link 50 and the axis of a vane 52 coincide with the cavity major axis 106. During this portion of the rotation of rotor 24, the vanes 54 in cavity half 104 are retracted in slots 96. Upon rotation of rotor 24 into the second cavity half 104, the vanes 54 are extended by the links 50 in the same manner while vanes 52 retract into slots 96. The provision of an intake port 112 in cavity 102 and an exhaust port 114 in cavity half 104 permits operation of the rotary machine as an internal combustion engine. A fuel-air mixture is drawn through the intake port 112 and is compressed by a vane 52 engaging the inner peripheral surface 84 of housing member 14. The compressed mixture attains a pressure sufficient to move transfer valve 118 against the force of spring 120 permitting flow past the top dead center position 108 into a chamber defined by a vane 54 of the second vane set and the inner peripheral surface 84 of housing member 14 in conjunction with the peripheral surface 125 of rotor 24. The spark plug 116 is then energized in a predetermined timed relationship to ignite the compressed air-fuel mixture causing rapid expansion against the vane 54 and propulsion of rotor 24. Rotation of the rotor 24 via flange 36 drives output shaft 28. Movement of vanes 54 in the second cavity half 104 sweeps burned gases out of exhaust port 114 which is placed a predetermined distance ahead of bottom dead center point 110 in the central housing member 14.

In the embodiments shown in FIGS. 3 and 4 the vanes have integral connecting members terminating in slippers slidably rotating upon their respective trunnions. This structure requires use of pivotal swivel bearings mounted in axially extending grooves adjacent the rotor peripheral surface. It is significant that during engine operation a portion of the swivel bearing halves 158 are exposed to the gases present in the chambers defined by the vanes in the engine housing. This gas pressure is effective to force the bearings into engagement with the rotor cylindrical grooves providing a sealed arrangement. The swivel bearing halves can also include spring structures to effect or assist in sealing engagement of the respective components during engine operation.

A significant feature of my invention resides in the possibility of rotary machine or engine operation without providing seal assemblies in the end surfaces 80 and 82 of the orbital vanes 52 and 54. By utilizing a predetermined surface curvature on the end surfaces 80 and 82 of the respective vanes 52 and 54 in conjunction with a predetermined effective length of links 50, the vanes 52 and 54 can be extended into a predetermined desired engagement with the inner peripheral surface 84 of housing member 14 establishing a relatively fluid tight fit without use of seals in surfaces 80 and 82.

The overall form of my orbital vane rotary machine eliminates dead space in the first cavity half wherein an air fuel mixture is compressed when the machine is being used as an internal combustion engine and likewise eliminates space in the second cavity half where combustion and expansion occurs. Since the housing cavity is in the form of two intersecting cylinders, each having equal radii and the rotor has a diameter substantially equal to the minor axis of the two-lobed circular cavity, the vanes of the first and second vane sets when extended into engagement with the housing peripheral wall substantially sweep all of the compressed and exhaust gases out of the housing. The exhaust port is placed immediately prior to the bottom dead center position in the housing so that substantially all of the exhaust gases are swept out by vanes in the second set. The only other possibility for a collection of unburned gases in the second cavity half would either be in the spark plug cavity or in the vane slots wherein the vanes are in a partially or fully retracted position. Utilization of the swivel bearing members in conjunction with fixed vane length portions substantially reduces volume of the vane slots. This is due to the fact that the swivel bearings are rocked in an opposite direction at bottom dead center as compared to the position at top dead center. Therefore, any gases collecting in the swivel bearing cavities or vane slots in a position near top dead center is rotated out of the rotor exteriorly of the rotor periphery by the time that particular vane reaches bottom dead center position and in this manner the collection of unburned gases for transfer into the compression first cavity half is substantially reduced. These quantities would have little effect upon subsequent combustion cycles. With regard to back flow resulting from a connection between the first and second cavity halves by virtue of a vane passing the spark plug recess, this possibility can be eliminated by utilizing a vane having a width greater than the spark plug recess preventing connection back to the first cavity half through the recess.

While the machine of my invention has been described as a rotary internal combustion engine it is of course possible to port the housing structure such that it can operate as a compressor or fluid pump. Also, the vane sets of my invention are shown as including three vanes with the two vane sets operating at an offset relationship on the respective trunnions 43 and 44 for purposes of description only. It is apparent that various numbers of vanes could be used in each vane set along with the fact that various numbers of vane sets themselves could be incorporated to provide most efficient operation in a particular installation.

While I have shown and described a particular embodiment of my invention, it will, of course be understood that various modifications and alternative constructions thereof may be made without departing from the true spirit and scope of my invention and that I intend by the appended claims to cover all such modifications and alternative constructions as fall within the true spirit and scope of my invention.

What is claimed is:

1. A rotary internal combustion engine comprising a housing having a cavity, a first half of said cavity being in the form of a segment of a cylinder having a first center axis and a predetermined radius, a second half of said cavity being in the form of a segment of a cylinder having a second center axis and a radius equal to that of said first half of said cavity, said center axes being spaced a predetermined distance providing a cavity major axis and a cavity minor axis at top dead center and bottom dead center positions of said housing cavity, a rotor having a diameter substantially equal to said minor axis centrally positioned in said cavity, an output shaft rotatably supported in said housing, said output shaft being secured to said rotor for rotation therewith, a first trunnion secured to said housing at the first center axis within said cavity, a first vane set including three equiangularly spaced vanes extending across the axial length of said cavity parallel to said output shaft, each vane being slidably mounted in said rotor for extension and retraction relative thereto, a plurality of connecting links pivotally connecting each of the vanes in said first vane set with said first trunnion for rotation thereabout, a second trunnion secured to said housing at the second center axis within said cavity, a second vane set including three equiangularly spaced vanes slidably mounted in said rotor and being specifically spaced relative to the vanes of said first vane set while also extending the axial length of said cavity parallel to said output shaft, a plurality of connecting links pivotally connecting the vanes of said second vane set to said second trunnion for rotation thereabout, the pivotal connection of each link to a respective vane permitting pivotal movement of the link relative to its respective vane such that in a full extended position the length of the link and its respective vane substantially equals the radius of said first and second one-halves of said cavity thereby assuring engagement of said vane with said cavity wall in such position, the vanes terminating in a curved end surface insuring engagement of the vane with said housing during rotation through the cavity while being in its extended position permitting operation of the internal combustion engine without incorporating seal assembles in the vane end surfaces, an intake port position in said housing directing an air-fuel mixture into said first one-half of said cavity, an exhaust port positioned in said housing in fluid connection with said second one-half of said cavity, ignition means connected to said housing adjacent the top dead cener position of said cavity for igniting a compressed fuel mixture therein, the vanes of said first vane set being extended from said rotor engaging said housing compressing the air-fuel mixture entering through said intake port during rotation through said first one-half of said cavity and retracting into said rotor out of engagement with said housing during rotation through said second one-half of said cavity, the vanes of said second vane set being extended from said rotor engaging said housing during combustion of said mixture powering said rotor and sweeping burned gases out of said exhaust port during rotation through said second one-half of said cavity and retracting into said rotor out of engagement with said housing during rotation through said first one-half of said cavity, and a transfer valve being positioned at the top dead center position of said housing, said valve being spring biased into engagement with said rotor preventing back flow of the compressed air-fuel mixture contained between a vane of said second vane set in engagement with said housing at a predetermined distance past dead center position permitting combustion of the compressed mixture by said ignition means and subsequent power output to said shaft.

2. A rotary internal combustion engine comprising a housing having a cavity, a first half of said cavity being in the form of a segment of a cylinder having a first center axis and a predetermined radius, a second half of said cavity being in the form of a segment of a cylinder having a second center axis and a radius equal to that of said first half of said cavity, said center axes being spaced a predetermined distance providing a cavity major axis and a cavity minor axis at top dead center and bottom dead center positions of said cavity, a rotor having a diameter substantially equal to said minor axis centrally positioned in said cavity, an output shaft rotatably supported in said housing, an accessory shaft rotatably supported in said housing, said output and accessory shafts being secured to said rotor for rotation therewith, a first trunnion secured to said housing within said cavity, a second trunnion secured to said housing within said cavity in axial spaced relation to said first trunnion, six axially extending slots in the form of segments of cylinders equiangularly spaced in the peripheral surface of said rotor, a pair of segments of cylinder halves positioned in each of said cylindrical slots forming swivel bearings having a vane groove therein, a first vane set including three equiangularly spaced vanes extending the axial length of said cavity parallel to said output shaft, each vane being slidably received in said swivel bearing grooves for extension and retraction relative to said rotor, a second vane set including three equiangularly spaced vanes slidably mounted in said swivel bearing valves forming said vane grooves each being specifically spaced relative to respective vanes of said first vane set while also extending the axial length of said cavity parallel to said output shaft, integral links formed on said vanes, arcuate slipper members on said links engaging the respective trunnions for sliding rotation thereon permitting rotation of said vanes about said trunnions, a plurality of retaining bands positioned over said slipper members and said trunnions for retaining said vanes in place, said integral link members being offset in one set with respect to the other vane set permitting engagement of the respective trunnions, an intake port positioned in said housing directing an air-fuel mixture into said first half of said cavity, an exhaust port positioned in said housing in fluid connection with said second half of said cavity, a spark plug mounted in said housing immediately past the top dead center position, electrical control means energizing said spark plug for igniting a compressed air-fuel mixture in a timed relationship, the vanes of said first vane set being extended from said rotor engaging said housing compressing said air-fuel mixture during rotation through said first half of said cavity and retracting into said rotor out of engagement with said housing during rotation through said second half of said cavity, the vanes of said second vane set being extended from said rotor engaging said housing during combustion of said mixture and powering said rotor sweeping burned gases out of said exhaust port during rotation through said second half of said cavity and retracting into said rotor out of engagement with said housing during rotation through said first half of said cavity, combustion pockets formed in the peripheral surface of said rotor between adjacent vanes of said first and second vane sets, said combustion pockets transporting a compressed air-fuel mixture from said first cavity half past said top dead center position in said housing into a chamber defined by an extended vane of said second vane set and said housing, said housing having a cavity formed at its top dead center position, and an insert adjustably positioned in said cavity varying the clearance between said rotor and said vanes at the top dead center position, thereby decreasing back flow of the compressed air-fuel mixture into said first cavity half during engine operation.

3. A rotary internal combustion engine comprising a housing having a cavity, a first half of said cavity being in the form of a segment of a cylinder having a first center axis and a predetermined radius, a second half of said cavity being in the form of a segment of a cylinder having a second center axis and a radius equal to that of said first half of said cavity, said center axes being spaced a predetermined distance providing a cavity major axis and a cavity minor axis at top dead center and bottom dead center positions of said cavity, a rotor having a diameter substantially equal to said minor axis centrally positioned in said cavity, an output shaft rotatably supported in said housing, an accessory shaft rotatably supported in said housing, said output and accessory shafts being secured to said rotor for rotation therewith, a first trunnion secured to said housing within said cavity, a second trunnion secured to said housing within said cavity in axial spaced relation to said first trunnion, six axially extending slots in the form of segments of cylinders equiangularly spaced in the peripheral surface of said rotor, a pair of segments of cylinder halves positioned in each of said cylindrical slots forming swivel bearings having a vane groove therein, a first vane set including three equiangularly spaced vanes extending the axial length of said cavity parallel to said output shaft, each vane being slidably received in said swivel bearing grooves for extension and retraction relative to said rotor, a second vane set including three equiangularly spaced vanes slidably mounted in said swivel bearing halves forming said vane grooves each being specifically spaced relative to respective vanes of said first vane set while also extending the axial length of said cavity parallel to said output shaft, integral links formed on said vanes, arcuate slipper members on said links engaging the respective trunnions for sliding rotation thereon permitting rotation of said vanes about said trunnions, a plurality of retaining bands positioned over said slipper members and said trunnions for retaining said vanes in place, said integral link members being offset in one set with respect to the other vane set permitting engagement of the respective trunnions, an intake port positioned in said housing directing an air-fuel mixture into said first half of said cavity, an exhaust port positioned in said housing in fluid connection with said second half of said cavity, a spark plug mounted in said housing immediately past the top dead center position, electrical control means energizing said spark plug for igniting a compressed air-fuel mixture in a timed relationship, the vanes of said first vane set being extended from said rotor engaging said housing compressing said air-fuel mixture during rotation through said first half of said cavity and retracting into said rotor out of engagement with said housing during rotation through said second half of said cavity, the vanes of said second vane set being extended from said rotor engaging said housing during combustion of said mixture and powering said rotor sweeping burned gases out of said exhaust port during rotation through said second half of said cavity and retracting into said rotor out of engagement with said housing during rotation through said first half of said cavity, combustion pockets formed in the peripheral surface of said rotor between adjacent vanes of said first and second vane sets, said combustion pockets transporting a compressed air-fuel mixture form said first cavity half past said top dead center position in said housing into a chamber defined by an extended vane of said second vane set and housing, said housing having a cavity formed at its top dead center position, and an insert adjustably positioned in said cavity varying the clearance between said rotor and said vanes at the top dead center position, a forward portion of said insert extending toward said first cavity half having the same radius as said first cavity half, an intermediate portion of said insert comprising a flat surface on a line tangent to a rotor combustion pocket when the latter rotates to the beginning point of said flat surface, and a rearward portion extending toward and having a radius equal to that of said second cavity half, said rearward portion beginning at the rearward end of said flat surface and being engaged by vanes of said second vane set thereby substantially decreasing back flow of the compressed air-fuel mixture into said first cavity half during engine operation.

* * * * *